US006390728B1

(12) United States Patent
Casters

(10) Patent No.: US 6,390,728 B1
(45) Date of Patent: May 21, 2002

(54) CONCRETE PAVING MACHINE AND DOWEL APPARATUS THEREWITH APPLIED

(75) Inventor: Francois Casters, Opglabbeek (BE)

(73) Assignee: Drion Constructie B.V.B.A. (BE)

( * ) Notice: Subject to any disclaimer, the term of this patent is extended or adjusted under 35 U.S.C. 154(b) by 0 days.

(21) Appl. No.: 09/267,702

(22) Filed: Mar. 15, 1999

(51) Int. Cl.[7] ..... E01C 11/16; E01C 19/12
(52) U.S. Cl. ..... 404/100; 404/104
(58) Field of Search ..... 404/88, 52, 100, 404/101, 118, 104, 84.1

(56) References Cited

U.S. PATENT DOCUMENTS

| | | | | | |
|---|---|---|---|---|---|
| 2,295,947 | A | * | 9/1942 | Heltzel | 404/88 |
| 4,312,602 | A | * | 1/1982 | Dale | 404/100 |
| 4,493,584 | A | * | 1/1985 | Guntert | 404/100 |
| 4,789,266 | A | * | 12/1988 | Clarke, Jr. et al. | 404/104 |
| 4,798,495 | A | * | 1/1989 | Laeuppi et al. | 404/88 |
| 4,799,820 | A | * | 1/1989 | Laeupi et al. | 404/88 |
| 5,190,397 | A | * | 3/1993 | Bengford et al. | 404/88 |
| 5,209,602 | A | * | 5/1993 | Godbersen | 404/88 |
| 5,405,212 | A | * | 4/1995 | Swisher, Jr. et al. | 404/88 |
| 5,615,972 | A | * | 4/1997 | Guntert et al. | 404/72 |
| 5,941,659 | A | * | 8/1999 | Godbersen | 404/100 |
| 6,099,204 | A | * | 8/2000 | Godbersen | 404/88 |

FOREIGN PATENT DOCUMENTS

| | | | | |
|---|---|---|---|---|
| DE | 24 46 768 | * | 4/1976 | 404/88 |
| DE | 38 11 186 A1 | | 10/1989 | |
| DE | 390643 | * | 10/1990 | 404/88 |
| EP | 51885 | * | 5/1982 | 404/88 |
| EP | 0 154 761 A2 | | 9/1985 | |
| EP | 0 196 698 A1 | | 10/1986 | |
| WO | WO 95/28525 | | 10/1995 | |

* cited by examiner

*Primary Examiner*—Thomas B. Will
*Assistant Examiner*—Kristine Markovich
(74) *Attorney, Agent, or Firm*—Bacon & Thomas, PLLC

(57) ABSTRACT

A concrete paving machine for leveling concrete having a frame and at least one dowel apparatus carried by the frame. The at least one dowel apparatus is movable along a working width of the concrete paving machine in a direction perpendicular to a paving path. The at least one dowel apparatus includes a vibration device and a dowel distribution device. The dowel distribution device comprises a series of longitudinal members having L-shaped profiles. Each longitudinal member forms a predetermined pattern of recesses wherein the series of longitudinal members are slidably arranged so that in an unlocked position, the recesses of each longitudinal member are aligned so as to permit distribution of at least one set of dowel bars. In a locked position, each longitudinal member is arranged to so that the recesses are misaligned so as to prevent distribution of at least one set of dowel bars.

18 Claims, 8 Drawing Sheets

CONCRETE PAVING MACHINE AND DOWEL APPARATUS THEREWITH APPLIED

BACKGROUND OF THE INVENTION

1. Field of the Invention

This invention relates to a concrete paving machine, more particularly a machine for levelling concrete, of the type whereby poured concrete is spread over a pre-determined width and this concrete is equalled at a well-defined thickness.

2. Description of the Related Art

As known, such concrete paving machines are applied for spreading and equalling of concrete, with the intention of forming a floor, plate, road or similar, whereby either or not simultaneously certain profilings can be provided in the formed road, such as a drain, an upstanding edge, a concrete crash barrier, or similar.

It is known that such concrete paving machines generally are composed of a movable frame under which a number of tools is fixed, the aim of which is to distribute the concrete poured in front of the machine, more or less equalling it, vibrating and finally drawing it equal, such that after passing of the concrete paving machine, a completely finished road is created, whereby hereafter one only has to wait for the hardening of the concrete, and eventually provided extension joints will have to be filled.

It is known to equip such concrete paving machines also with a dowel apparatus for providing dowels in the concrete, mostly at the height of the extension joints. Such dowels are reinforcing bars, mostly with a length of approximately 0.5 meters, which are provided in the concrete in the longitudinal direction of the road. Mostly, a whole series of such dowels is provided next to each other, at mutual distances of 20 to 30 cm.

The dowel apparatuses applied hereby are apparatuses which allow to position such series of dowels above the concrete next to each other and to vibrate these dowels subsequently into the concrete. Hereby, the dowel apparatuses are suspended at the concrete paving machine in such a manner that they can remain stationary for a certain period of time in order to vibrate the dowels into the concrete, during which the actual concrete paving machine slowly moves further.

Known embodiments of concrete paving machines with dowel apparatuses are described in EP 0.051.885, EP 0.196.698, and DE 3.811.186.

BRIEF SUMMARY OF THE INVENTION

The invention has a concrete paving machine as its object which is improved in respect to the known embodiments.

To this aim, the invention aims at a concrete paving machine of the above-mentioned type, with as a characteristic that the concrete paving machine is provided with at least one dowel apparatus, whereby this dowel apparatus is movable according to the working width.

As the dowel apparatus is movable, the advantage is created that the dowel apparatus must not necessarily extend over the entire maximum working width of the concrete paving machine, as a result of which this dowel apparatus can be kept small and light-weight in relation to the dimensions of the entire concrete paving machine. The dowel apparatus which, as will become clear from the further description, is rather complex and also takes up relatively much space in the height, then can, due to its relatively small width, easily be transported to the site where it has to be used or can easily be mounted permanently at the concrete paving machine.

According to a particular embodiment of the invention, the dowel apparatus is mounted to the paving machine at such a height that it is located at a distance above the upper surface of the levelled concrete, resulting in that there is no contact between the concrete and the lower portion of the dowel apparatus. In this way, amongst others, the advantage is attained that the frame of the dowel apparatus cannot cause irregularities in the surface of the concrete, contrary to the devices disclosed in EP 0.051.885, EP 0.196.698 and DE 3.811.186, in which at the location of the dowel apparatus always a slide is provided which is in contact with the concrete.

A feature that the dowel apparatus is mounted freely above the concrete is particularly advantageous in combination with the dowel apparatus which is movable according to the working width, but, according to the present invention, can also be applied in concrete paving machines having a dowel apparatus which is not movable according to the working width, for example, a dowel apparatus extending over the complete width of the machine.

According to another particular feature of the invention, the machine is provided with means for automatically controlling and adjusting the distance between the lower portion of the dowel apparatus and the surface of the levelled concrete. These means may consist of detection means to control the height of the dowel apparatus in respect to the upper surface of the concrete and of driving means to bring at least a lower portion of the dowel apparatus at the required height. Preferably, the adjustment is done automatically, such that the distance remains constant.

BRIEF DESCRIPTION OF THE DRAWINGS

With the intention of better showing the characteristics according to the invention, hereafter, as examples without any limitative character, several preferred forms of embodiment are described, with reference to the accompanying drawings, wherein.

DETAILED DESCRIPTION OF THE INVENTION

Figure 1:
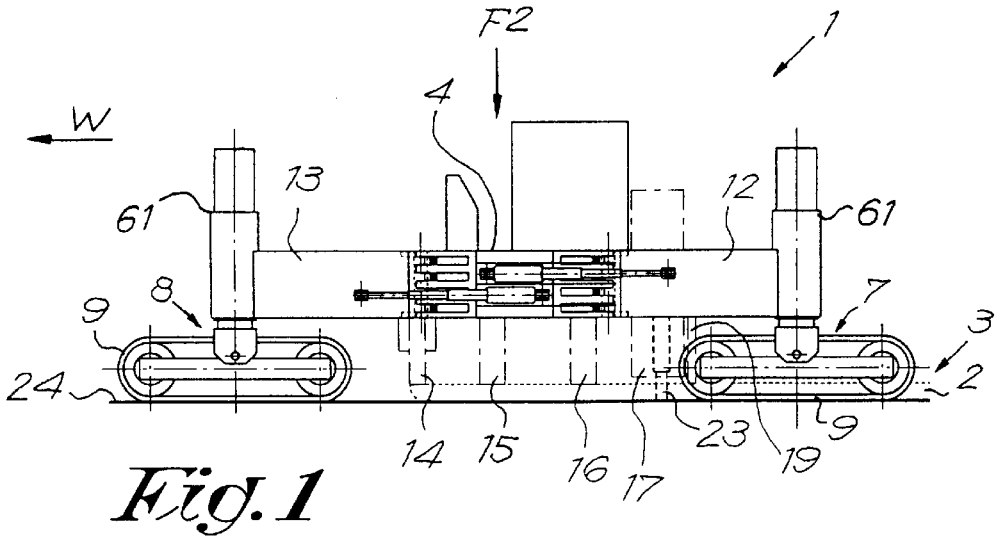
FIG. 1 schematically represents a concrete paving machine according to the invention.
Figure 2:
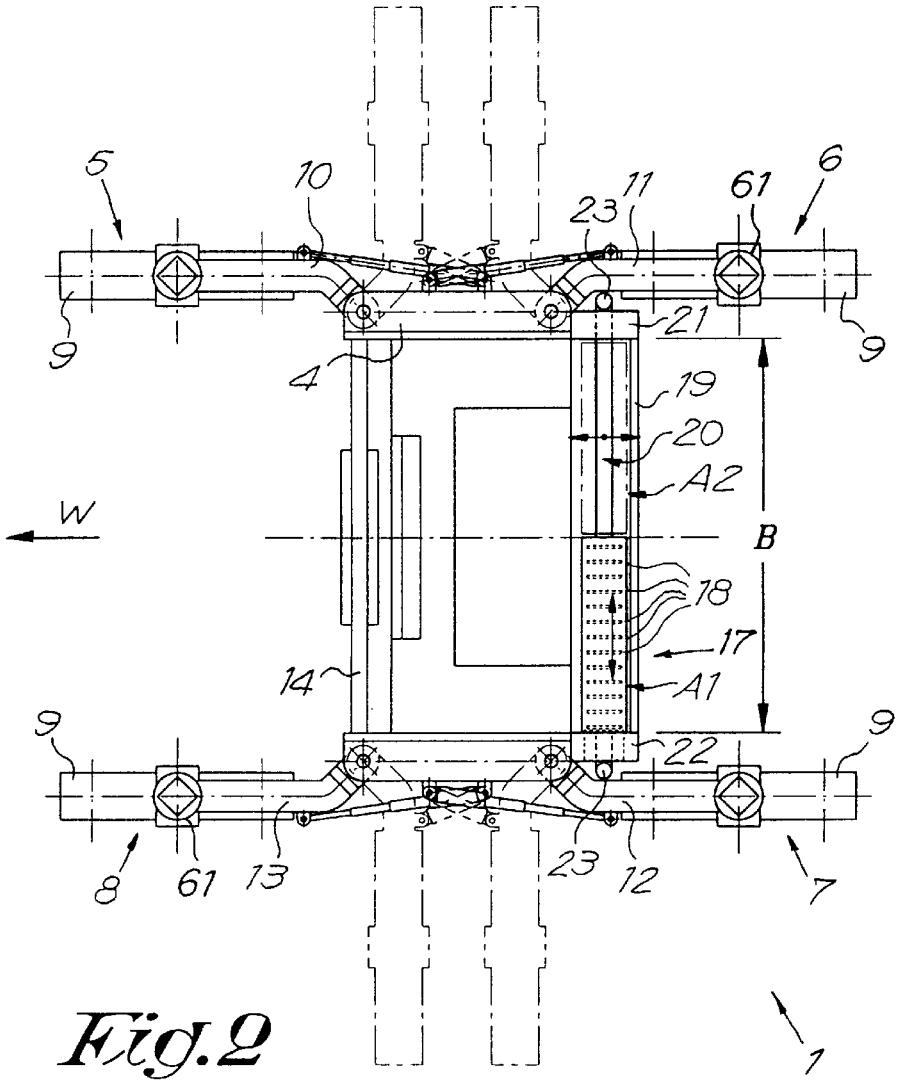
FIG. 2 represents a view according to arrow F2 in FIG. 1.

As represented in FIGS. 1 and 2, the invention relates to a concrete paving machine 1 for levelling concrete 2, of the type whereby poured concrete 2 is spread over a predetermined width and this concrete 2, in order to form a road 3 or similar, is equalled at a well-defined thickness or in a well-defined shape.

Amongst others, such concrete paving machine 1 consists of a frame 4 and support means which allow to move and/or to roll away this frame 4 which, in this case, consist of four support elements, 5-6-7-8 respectively, which are provided with, for example, tracks 9 which are driven by means of motors, not represented in the figures, more particularly, hydraulic motors which are provided at the height of each support element 5-6-7-8.

In this case, the support elements 5-6-7-8 are pivotable around the corners of the concrete paving machine 1, as they are attached at pivotable arms 10-11-12-13, as a result of which the whole can be switched between a working position, such as represented in FIG. 2 in full line, and a transport position which is represented in a dash-dot-line.

At the frame 4, and possibly also at the support elements 5-6-7-8, various tools, in this case, five, are attached. More particularly, in this case, it concerns a device 14 for spreading the concrete 2, a device 15 for vibrating the concrete 2, a shaping piece 16 for giving a shape to the concrete 2, a dowel apparatus 17 for bringing dowels 18 into the concrete 2, and a smoothening device 19 in order to provide for a smooth finishing. For clarity's sake, these tools 14-15-16-17-19 are depicted only in a very schematic manner. Hereby, it is also obvious that not all aforementioned tools 14-15-16-17-19 necessarily have to be present and that possibly still other tools may be provided at the concrete paving machine 1.

The particularity of the invention consists in that the aforementioned dowel apparatus 17 is movable according to the working width B.

As indicated schematically in FIG. 2, the concrete paving machine 1 is provided with a guide 20 along which the dowel apparatus 17 can be moved. This movement can be obtained by means of conventional driving means, such as pressure cylinders or chain drives or cable drives which, for clarity's sake, are not represented in the FIGS. 1 and 2.

The concrete paving machine 1, of course, is also provided with means which allow the dowel apparatus 17 concerned to perform a movement perpendicular to the working width of the concrete paving machine 1, in such a manner that the dowel apparatus 17 can be kept stationary for a certain period of time, whereas the actual concrete paving machine 1 moves further, as well as means which hold the dowel apparatus 17 in its stationary position.

According to the invention, the first-mentioned means consist of guides 21 and 22 at which the aforementioned guide 20 is suspended, in such a manner that the guide 20, together with the dowel apparatus 17 attached thereto, can be kept for a certain period of time on one and the same place according to the direction W, whereas the concrete paving machine 1 is rolling further.

According to a particular embodiment of the invention, the means which can hold the dowel apparatus 17 according to the direction W in a stationary position consist of supports 23 formed, for example, of pressure cylinders with elements which are extensible vertically downward, for example, cylinder bars, which can be lowered next to the concrete road 3 onto the ground 24 and/or can be pressed in the ground 24, in such a manner that the guide 20 and a dowel apparatus 17 suspended thereupon are locked against displacement in the direction W.

Figure 10:
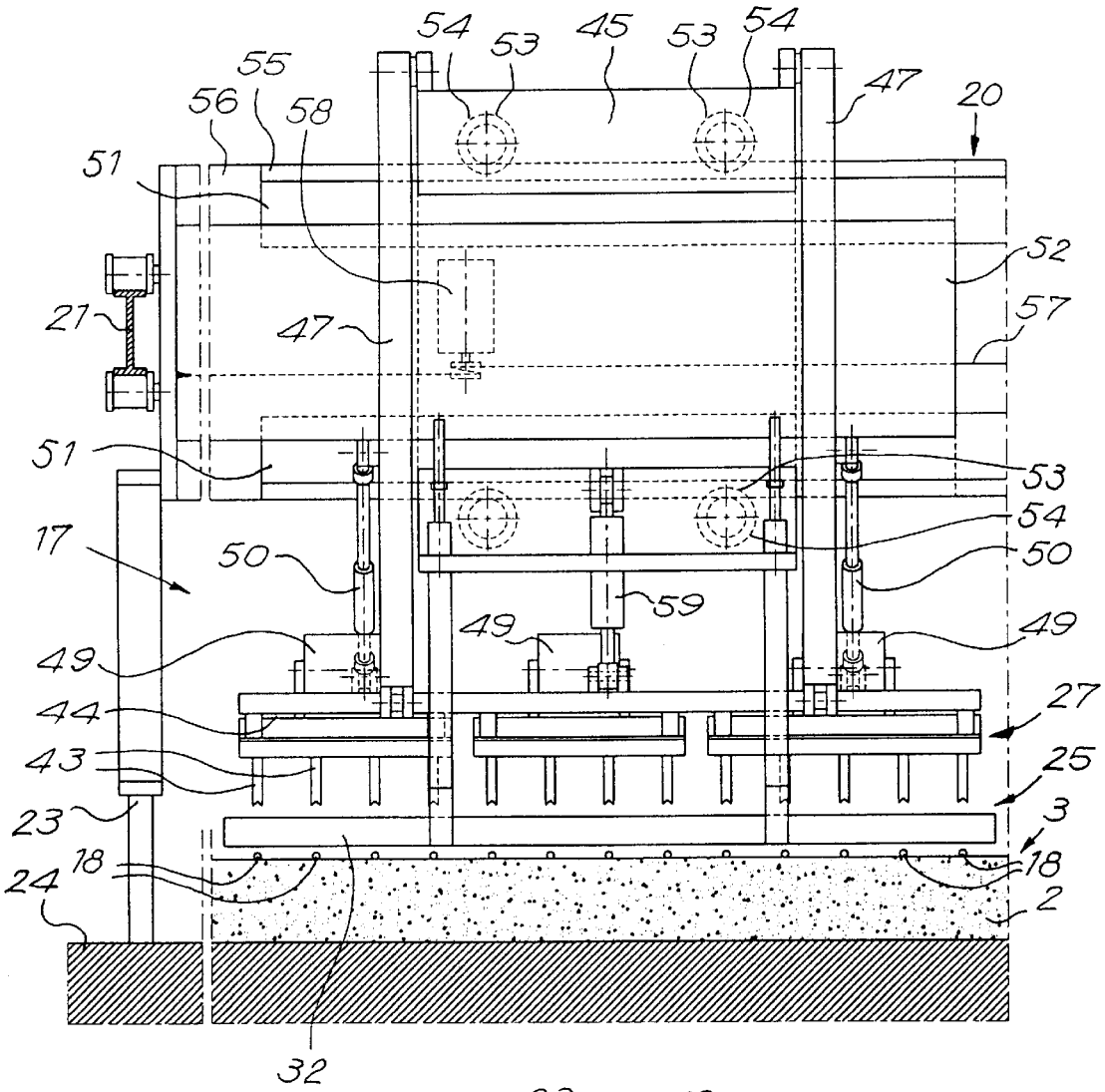
FIG. 10 represents a view according to arrow F10 in FIG. 9, for a somewhat different position.

A more detailed view thereof is represented in FIG. 10 which further is described hereafter.

It is noted that the guides 21–22, the guide 20 and the dowel apparatus 17 can be attached dismountable at the frame 4, in such a manner that, in the transport condition of the concrete paving machine 1, they can be removed.

The use of the dowel apparatus 17 is represented schematically in FIG. 2. First, this dowel apparatus 17 is placed into a position A1, and it is provided with dowels 18. At the moment when the dowels 18 have to be brought into the concrete 2, these are set free for the dowel apparatus 17. Subsequently, the dowel apparatus 17 is brought into the position A2, whereas the guide 20 according to the working direction W is held on the same place. Thereafter, in this position A2, also a series of dowels 18 is brought into the concrete 2.

Subsequently, the guide 20, over guides 21 and 22, can be drawn towards the frame 4.

In the embodiment of FIGS. 1 and 2, the width covered by the dowel apparatus 17 preferably is half of the total working width B.

Figure 3:
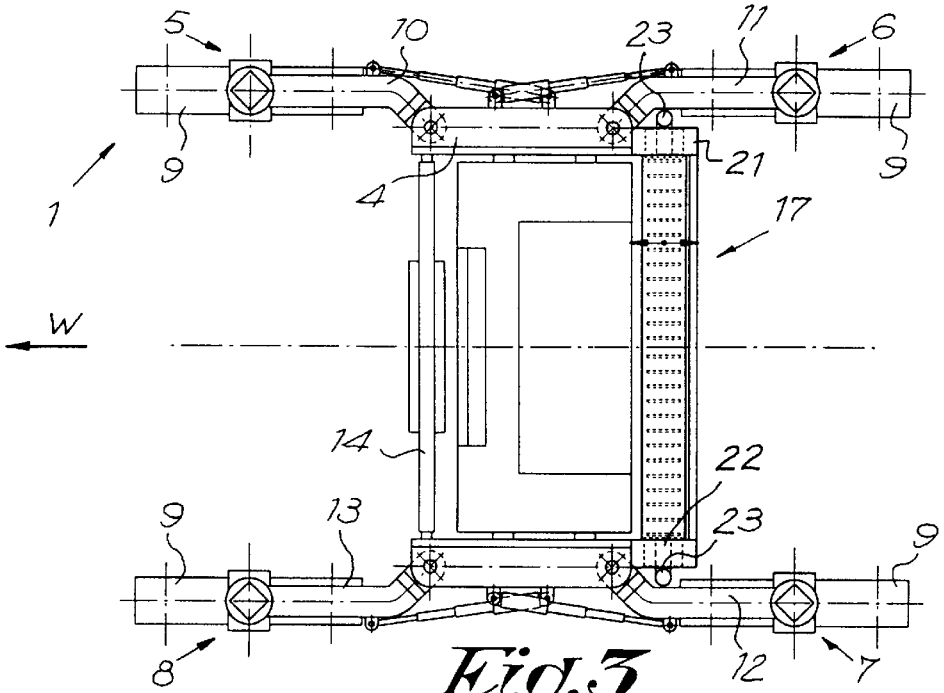
FIG. 3 represents a variant of the concrete paving machine, in top view.
Figure 4:
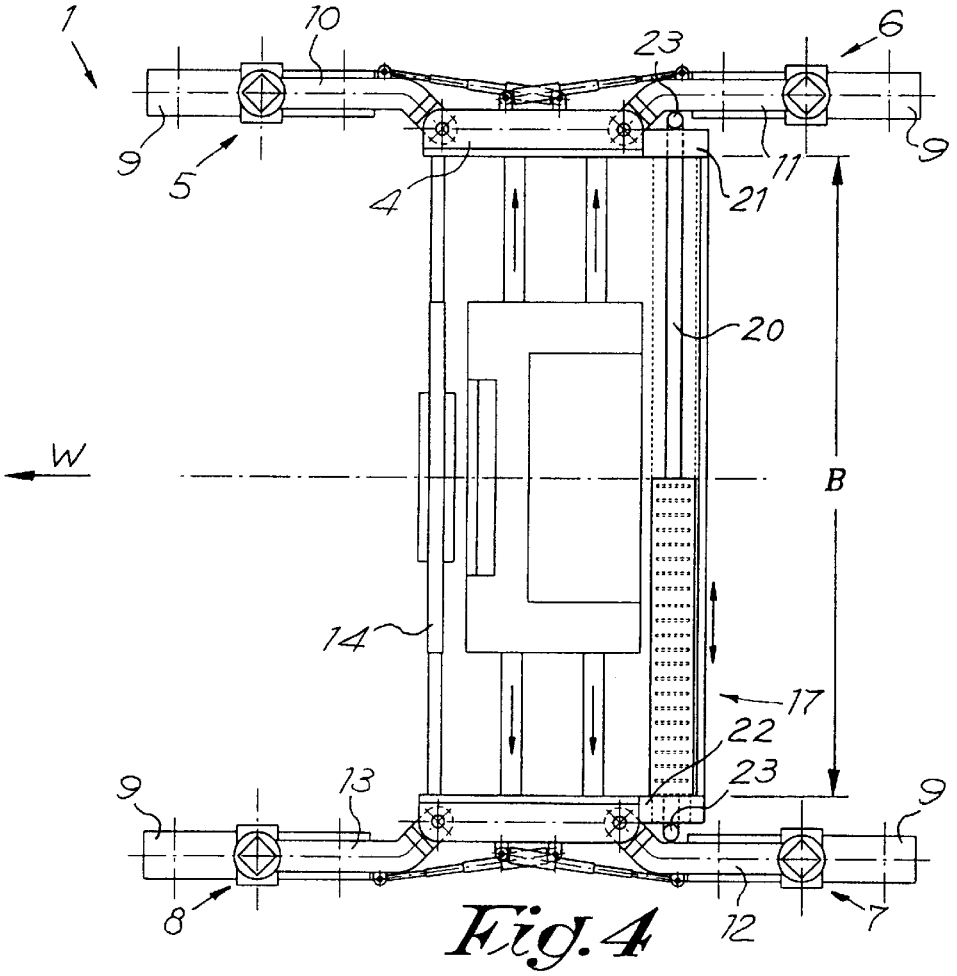
FIG. 4 represents the concrete paving machine from FIG. 3 in another position.

In FIGS. 3 and 4, a variant is represented whereby the concrete paving machine 1, more particularly, the frame 4 thereof, is extensible according to the working width.

A particularity of the embodiment of FIGS. 3 and 4 consists in that the dowel apparatus 17 applied therein extends over a width which is equal to the working width in the slid-together condition of the concrete paving machine 1. Another particularity herein consists in that the maximum working width of the concrete paving machine 1, thus, the working width in maximally extended position, is twice the width covered by the dowel apparatus 17.

In this embodiment, the guide 20 preferably shall be extensible, such that the working width can be continuously adapted to the width of the concrete road 3 to be realized. Hereby, it is noted that in the case that the working width is no multiple of the width covered by the dowel apparatus 17, the two positions into which the dowel apparatus 17 shall be brought shall overlap each other. This, however, does not form a problem in that then it only has to be taken into account that, at the height of the overlapping part, dowels 18 must be provided only once.

Figure 5:
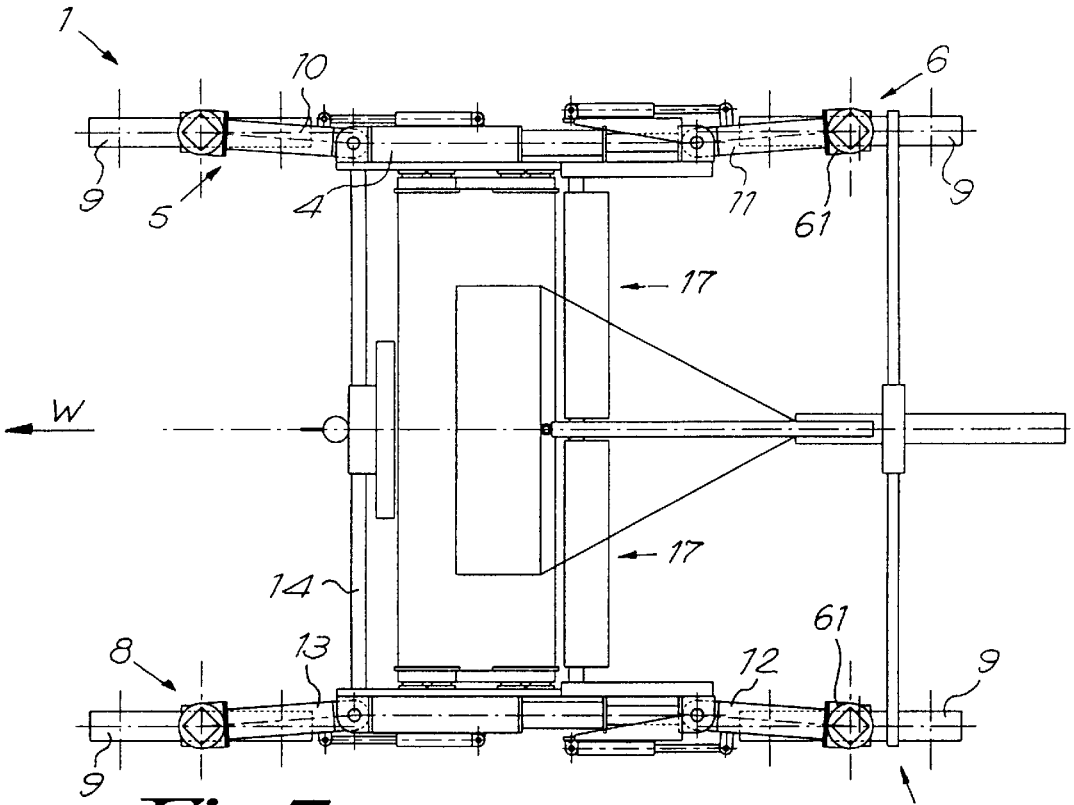
FIG. 5 represents another concrete paving machine according to the invention, in top view.
Figure 6:
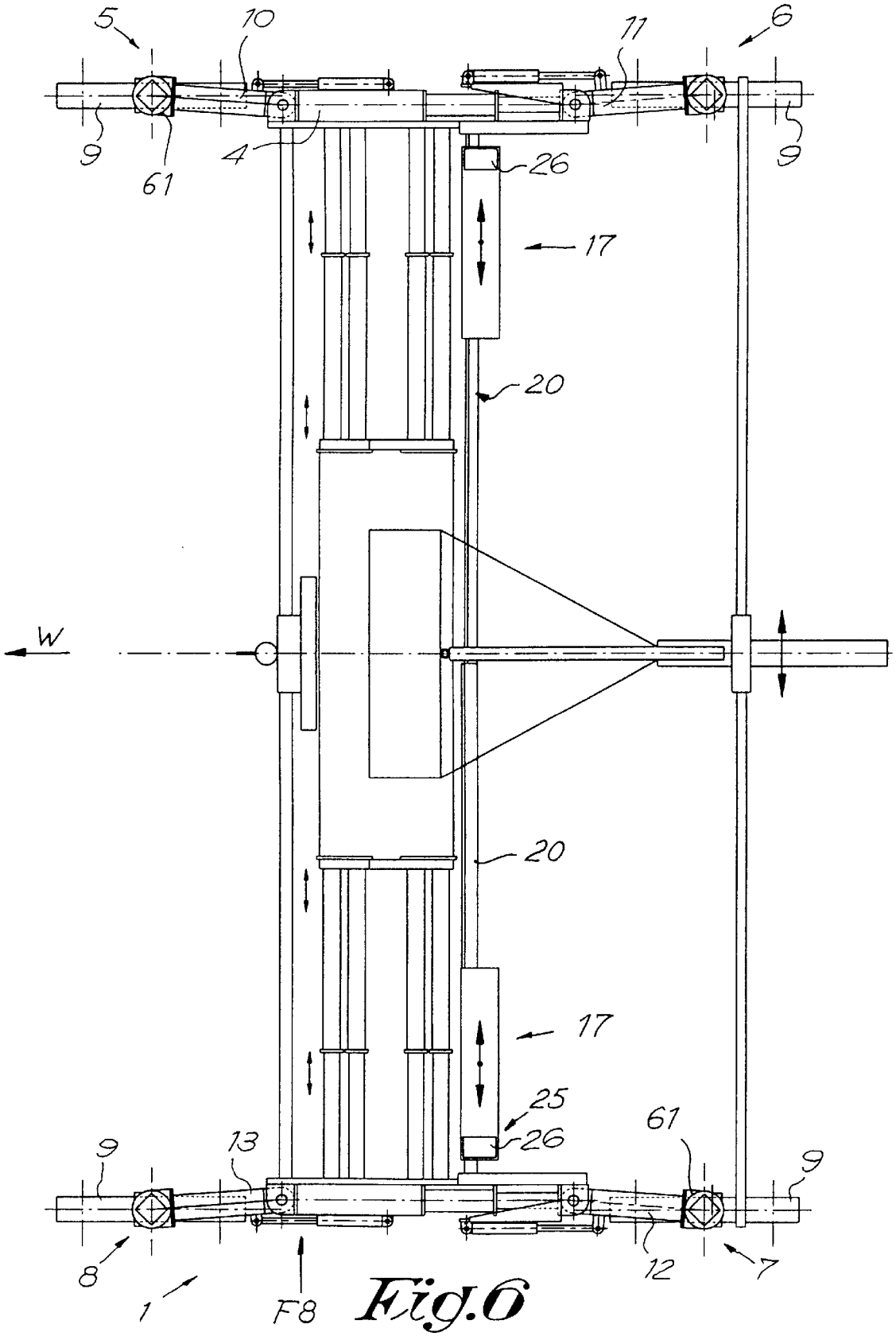
FIG. 6 represents the concrete paving machine from FIG. 5 in another position.
Figure 7:
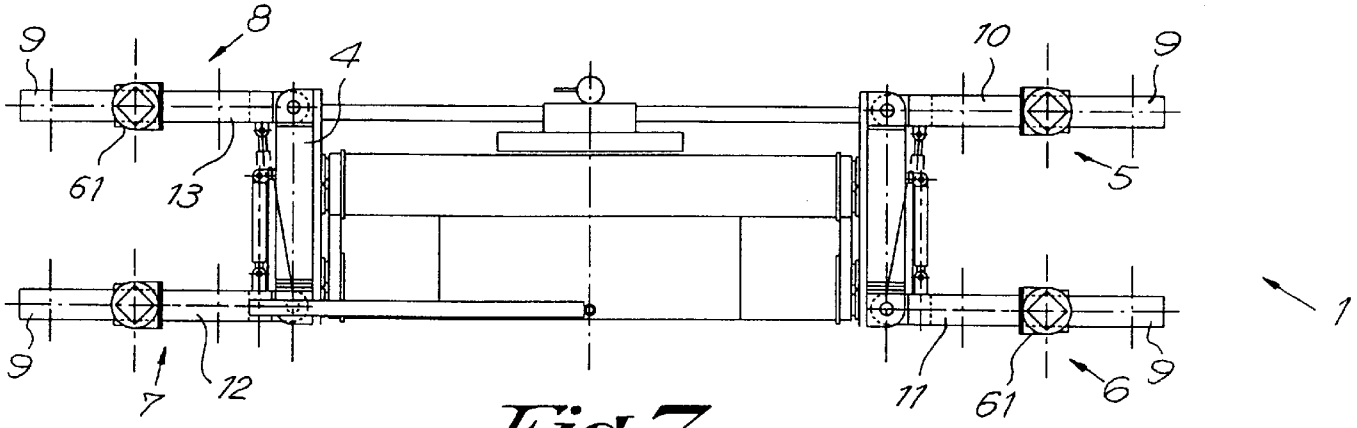
FIG. 7 represents the concrete paving machine from FIG. 5 in transport condition.

In the most preferred form of embodiment, the concrete paving machine 1 shall be provided with at least two, and even better precisely two, dowel apparatuses 17 which are movable according to the working width, such as represented in FIGS. 5 and 6. These dowel apparatuses 17 are situated substantially in line next to each other.

As represented in FIGS. 5 and 6, the concrete paving machine 1 hereby can be extensible. It is particularly advantageous that in this case the two dowel apparatuses 17, in the slid-together condition of the concrete paving machine 1, cover the entire working width B, such as visible in FIG. 5.

The dowel apparatus 17 may be of any construction. Preferably, however, a dowel apparatus 17 shall be applied,. such as described hereafter by means of FIGS. 9 to 17, which dowel apparatus 17 can be applied in the concrete paving machine 1 from FIG. 5 as well as in the one from the figures preceding it.

Hereby, the dowel apparatus 17 substantially consists of, on one hand, a distribution device 25, which can be positioned above the concrete road 3 to the formed, for the distribution of dowels 18 over the width of the dowel apparatus 17, as well as for retaining these dowels 18 for a certain period of time in order to be able to deposit them subsequently on the concrete 2, whereby this distribution device 25 is provided with a movable carriage 26 or slide for the dowels 18 and, on the other hand, a device 27 for vibrating the dowels 18 into the concrete 2.

The distribution device 25 for distributing the dowels 18 and retaining them for a certain period of time consists, as represented in the FIGS. 11 to 16, of a distribution frame 28 which is provided with recesses 29 in which the dowels 18 can be provided, and shiftable locking means 30 cooperating with this distribution frame 28 which, in locked position, prevent the dowels 18 from dropping through the recesses 29, and, in unlocked position, provide for that the dowels 18 well can drop through these recesses 29 downward onto the concrete 2.

The distribution frame 28 substantially is made in the form of a framework, with hollow longitudinal members 31–32 having an L-shaped profile. Hereby, the aforementioned recesses 29 are provided opposite in the lowermost flanges 33 of the longitudinal members 31–32 and form seats in which dowels 18 can be positioned at well-defined distances from each other.

The aforementioned locking means 30 substantially are formed of a slide which is movable between at least two positions, a position whereby this slide prevents that the dowels 18 drop off the aforementioned seats, and a position whereby the aforementioned recesses are set free, respectively. As visible in FIGS. 11 to 16, this slide is formed by two longitudinal members 34–35, in which recesses 36 are provided in the lowermost flanges 37. Hereby, the longitudinal members 34–35 are slidable in the hollow longitudinal members 31–32, in such a manner that, in a first position, the recesses 29 are closed off beneath by means of the flanges 37 and, in a second position, the recesses 36 become situated opposite to the recesses 29, in such a manner that a free passage is created for the dowels 18 and the latter can drop downward.

Figure 11:
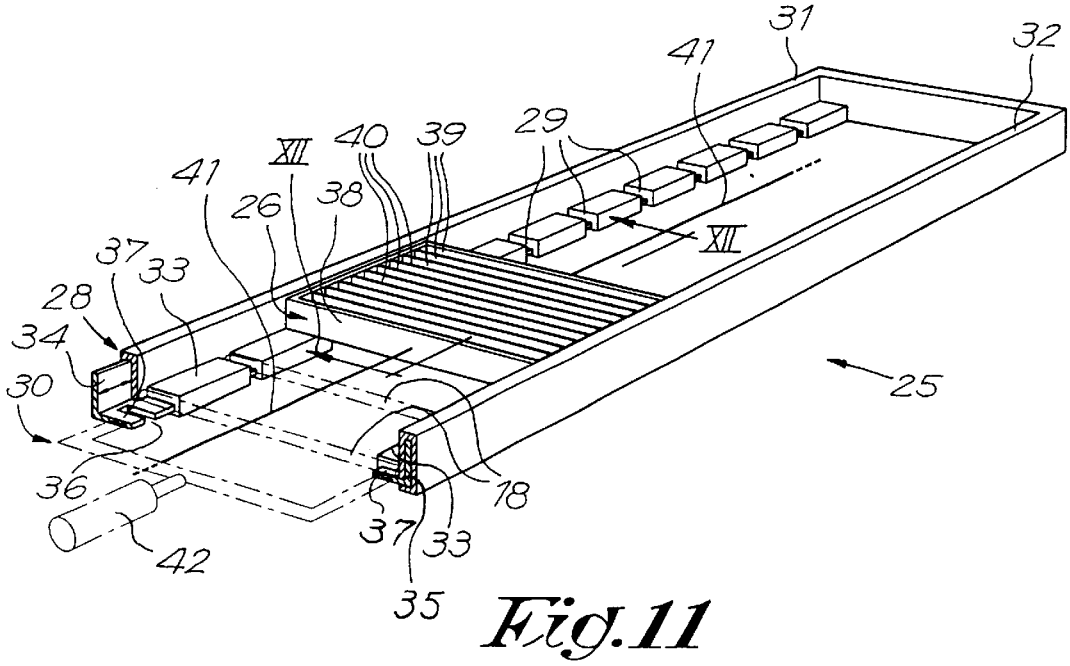
FIG. 11 in perspective represents a view of the portion which is indicated by arrow F11 in FIG. 9.
Figure 12:
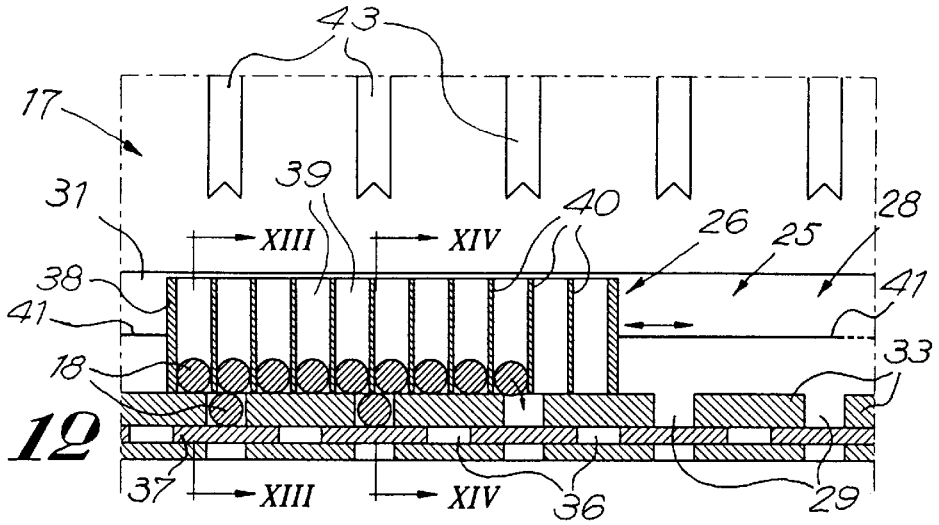
FIG. 12 represents a cross-section according to line XII—XII in FIG. 11.

As clearly visible in the FIGS. 11 and 12, the aforementioned carriage 26 substantially consists of a framework 38 which can be slid over the longitudinal members 31 and 32, with compartments 39, separated by partitions 40, in which each time a dowel 18 can be placed. The compartments 39 are without bottom.

It is obvious that driving means are provided to move the carriage 26. As schematically represented in FIG. 11, to this aim use can be made of cables 41 with which the carriage 26 can be shifted to and fro, for example, by means of a not represented motor.

In FIG. 11, also the drive for shifting the locking means 30 between the aforementioned two positions is also represented schematically, which drive consists of a pressure cylinder.

The vibration device 27 for vibrating the dowels 18 into the concrete 2 consists of pressing elements 43 which are attached at a frame 44 which, in this case, by means of a parallelogram construction formed by the basic frame 45 of the dowel apparatus 17 and the arms 46-47-48, can be moved up and down by means of a pressure cylinder 59. The vibration effect is obtained by means of vibration motors 49. In case of possible deviations, the position of the frame 44, more particularly its being parallel with the concrete road 3 to be formed, can be regulated by means of adjustment elements 50.

Figure 9:
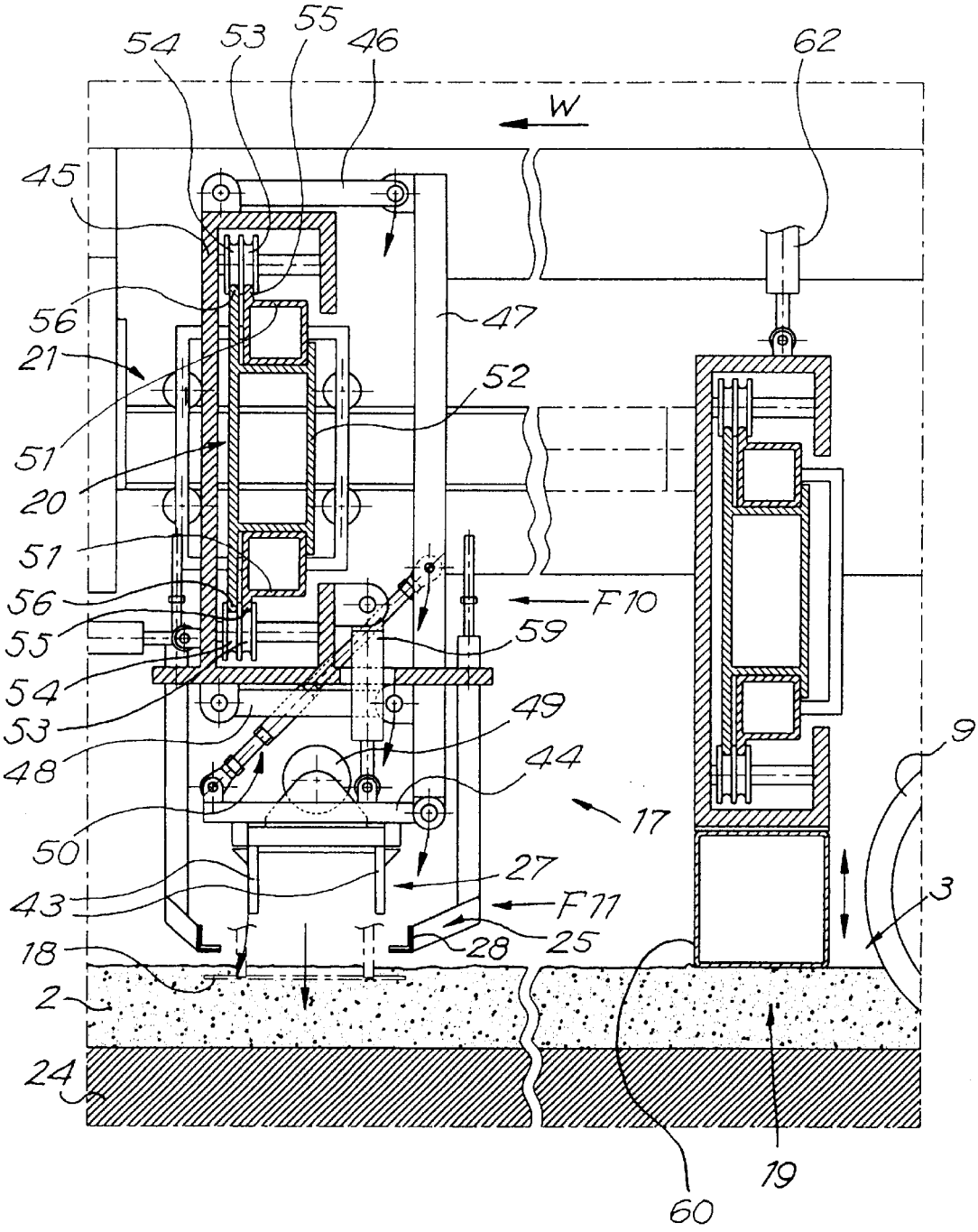
FIG. 9, at a larger scale and more detailled, represents the portion which is indicated by F9 in FIG. 8.

In the FIGS. 9 and 10, it is visible that the guide 20 consists of telescopically extensible parts 51 and 52. The dowel apparatus 17 can be moved along these by means of guiding wheels 53–54 which cooperate with rails 55–56 which are provided at the parts 51 and 52, respectively, such that such dowel apparatus 17 can roll over smoothly from one part to the other.

As indicated schematically in FIG. 10, the concrete paving machine 1 is provided with driving means for moving the respective dowel apparatuses 17 in function of the work to be performed, which driving means per dowel apparatus 17 consist, for example, of a cable 57 and a motor 58 with which the basic frame 45 can be moved along the guide 20.

Of course, reset means are also provided for placing the guide 20, together with the dowel apparatuses 17 suspended thereon, back to the starting extremity of the guide 21–22, after the dowels 18 have been vibrated into the concrete 2. These reset means can, for example, consist of one or several pressure cylinders which are not represented in the figures.

According to the invention, the concrete paving machine 1 can be provided with means allowing an independent height adjustment at least at two places, viewed in the direction perpendicular to the working direction. In this manner, it is obtained that the height adjustment of different tools can take place independently. This is important in the first place in concrete paving machines 1 which are relatively long in working direction and can bend relatively far. As a result of the independent height adjustments, each tool concerned then can be precisely adjusted in height, for example, in function of a guideline or similar which is stretched alongside the road, or in function of any other guiding means, such as, for example, a laser beam.

Figure 8:
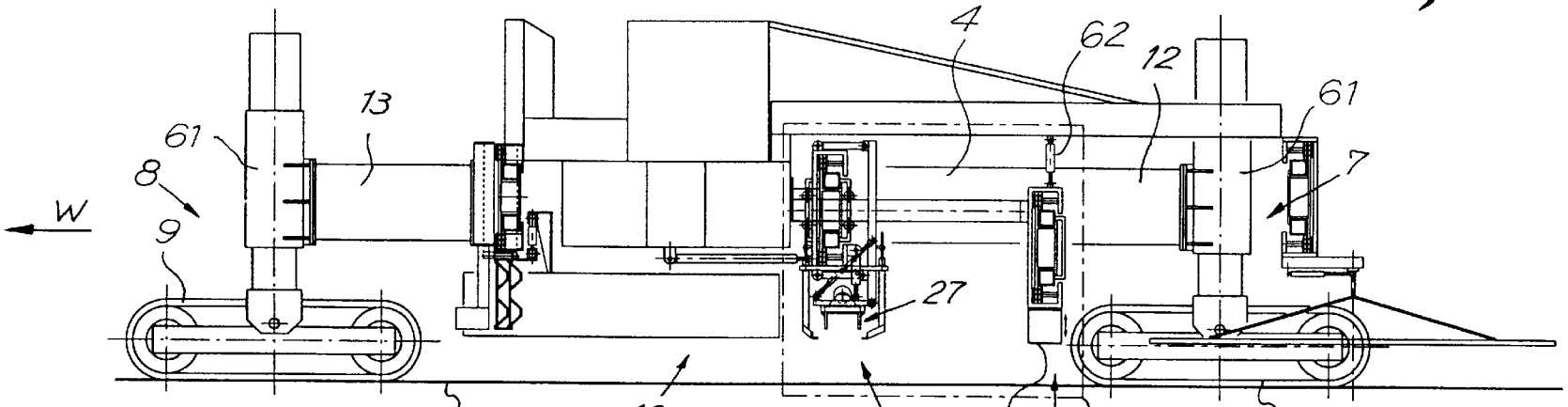
FIG. 8 schematically represents a view according to arrow F8 in FIG. 6.

In the example of the FIGS. 8 and 9, an independent height adjustment is provided of, on one hand, the dowel apparatuses 17 and, on the other hand, a smoothening beam 60.

Hereby, the distance of the dowel apparatus 17 above the surface to be paved with concrete is regulated by height-adjustment means formed by pressure cylinders 61 at the height of the support elements 5-6-7-8. The independent height adjustment of the smoothening beam 60 is performed by means of separate pressure cylinders 62 or similar.

The working of the concrete paving machine 1 described heretofore can easily be deduced from the figures.

Hereby, first the aforementioned slide, formed by the longitudinal profiles 34–35, is placed into the position of FIG. 12. The carriages 26 are situated at the lateral edges of the concrete paving machine 1 and, for example, are filled manually with the exact number of dowels 18. Subsequently, these carriages 26 are moved over the longitudinal profiles 31–32, as a result of which, as represented in FIG. 12, precisely one dowel 18 is placed in each pair of opposite recesses 29, this because these recesses 29 are of such dimensions that only one dowel 18 can take place therein.

At that moment when the dowel apparatuses 17 are situated at the place where the dowels 18 have to be vibrated into the concrete 2, first the locking means 30 are put into working, more particularly, first the supports 23 are lowered, as a result of which the guide 20 remains standing at that location.

Figure 15:
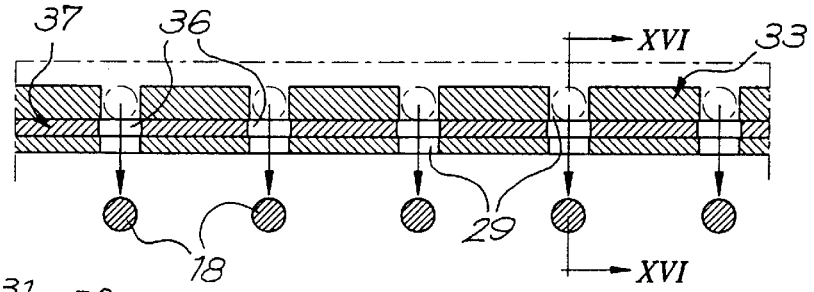
FIG. 15 represents the lowermost portion from FIG. 12 in another condition.
Figure 13:
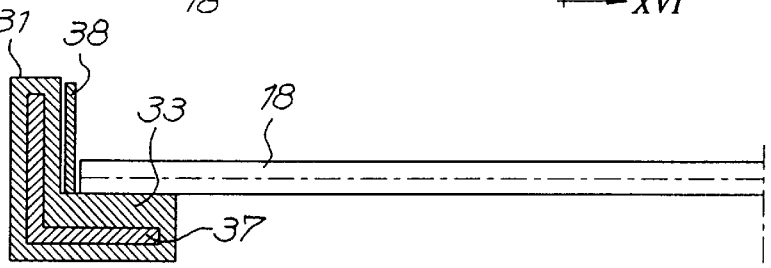
FIGS. 13 and 14 represent cross-sections according to lines XIII—XIII and XIV—XIV in FIG. 12, respectively.
Figure 14:
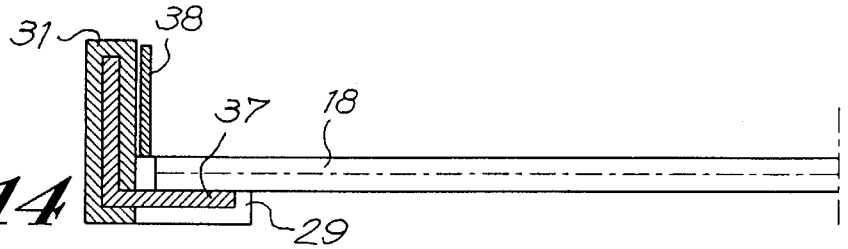
Figure 16:
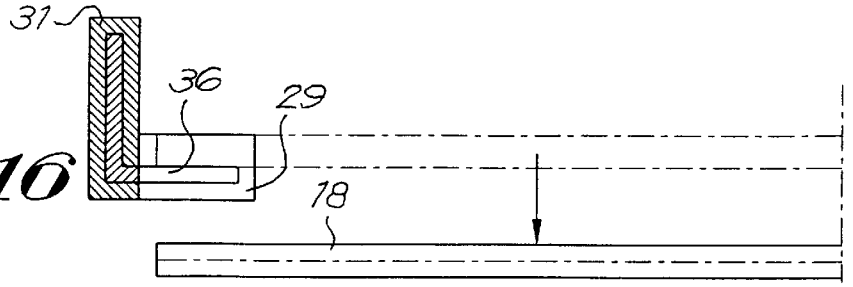
FIG. 16 represents a cross-section according to line XVI—XVI in FIG. 15.

Subsequently, the slides are moved in such a manner that the recesses 36 are positioned opposite the recesses 29, as a result of which, as represented in FIGS. 10, 15, and 16, the dowels 18 drop onto the concrete 2.

Hereafter, the parallelogram-shaped frame 44 is lowered, whereas the vibrating motors 49 are switched on. Hereby, the pressing elements 43 push the dowels 18 into the concrete, after which the frame 44 can be positioned upward again.

Subsequently, this can be repeated on adjacent places by moving the dowel apparatuses 17 step by step.

It is obvious that the concrete paving machine 1 is provided with the necessary control means in order to let all driven movements take place automatically, according to the desired cycle. More particularly, these control means will provide for that, first, dowels 18 are vibrated into the concrete 2 in the positions of the dowel apparatuses 17 as represented in FIG. 6, that, subsequently, the dowel apparatuses 17 are moved more inward and dowels 18 there are vibrated into the concrete 2, and this so on until dowels 18 are provided in the concrete 2 over the entire width of the concrete road 3.

As explained in the introduction, preferably the distance between the frame 28 and the concrete 2 is kept automatically constant by adjusting the height of the dowel apparatus 17. This adjustment allows that the distance can be kept as small as possible, for example, two centimeters, having the advantage that the distance over which the dowels 18 are dropped is very small, too, so that it can be guaranteed that the dowels 18 still are positioned under the pressing elements 43 at the end of their falling movement.

Figure 17:
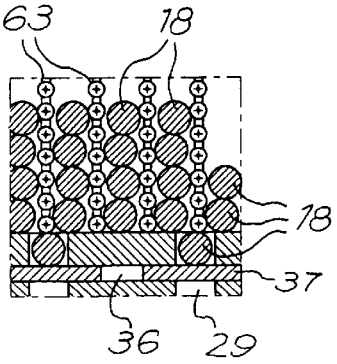
FIG. 17 represents a variant of a carriage which can be applied in the portion from FIG. 11.

In FIG. 17, a variant of the carriage 26 is represented which allows to provide several dowels 18 on top of each other in each of the compartments 39, without the dowels 18 getting stuck. This is obtained in that the partitions 40 in this case are formed by rotatably beared elements 63, such as roller bearings.

The present invention is in no way limited to the forms of embodiment described by way of example and represented in the figures, on the contrary may such concrete paving machine be realized in various forms and dimensions without leaving the scope of the invention.

What is claimed is:

1. A concrete paving machine for leveling concrete along a paving path, said concrete paving machine comprising:

a frame having a front end and a rear end, said frame having a maximum working width extending in a direction substantially perpendicular to the paving path; and at least one dowel apparatus carried by said frame, said at least one dowel apparatus operating and arranged as a unitary unit including a device for supplying and inserting a plurality of dowels in a distributed manner over a predetermined width parallel to said maximum working width, said at least one dowel apparatus having a dimension shorter than the maximum working width of the paving machine, wherein said at least one dowel apparatus is arranged to be displaced along said maximum working width as said unitary unit such that said at least one dowel apparatus distributes dowels over different portions along said working width.

2. The concrete paving machine according to claim 1 wherein said frame has an extensible working width, said frame being operable between a minimum working width and a maximum working width.

3. The concrete paving machine according to claim 2, wherein said dowel apparatus spans substantially half of said maximum working width.

4. The concrete paving machine according to claim 2, wherein said dowel apparatus spans substantially all of said minimum working width.

5. The concrete paving machine according to claim 1 further comprising at least another dowel apparatus being movable along said working width.

6. The concrete paving machine according to claim 5 wherein said at least two dowel apparatuses are substantially juxtaposed along said working width.

7. The concrete paving machine according to claim 5 wherein said frame has an extensible working width, said frame being operable between a minimum working width and a maximum working width, wherein said at least two dowel apparatuses span substantially all of said minimum working width.

8. The concrete paving machine according to claim 1 wherein said at least one dowel apparatus is configured to be positioned stationary with respect to said paving path as said frame travels along said paving path, and wherein said at least one dowel apparatus is supported by a plurality of end supports, said plurality of end supports being lowered onto a ground surface adjacent to the concrete to maintain said at least one dowel apparatus in a stationary position.

9. The concrete paving machine according to claim 1 wherein said at least one dowel apparatus is configured to be positioned stationary with respect to said paving path as said frame travels along said paving path, said at least one dowel apparatus being arranged with end guides mounted along lateral sides of the frame such that said at least one dowel apparatus travels along said paving path between a forward position directed towards said front end and a rear position directed towards said rear end of said frame.

10. The concrete paving machine according to claim 1 wherein said at least one dowel apparatus comprises a distribution device being arranged above the concrete and adapted to drop at least one set of dowel bars onto the concrete in a predetermined sequence, said distribution device comprising a distribution frame having a series of recesses and a movable locking means that cooperates with said distribution frame, wherein said movable locking means operates between a locked mode whereby said at least one set of dowel bars remain in said dowel distribution device, and an unlocked position whereby said at least one set of dowel bars is distributed onto the concrete.

11. The concrete paving machine according to claim 10 wherein said at least one dowel apparatus comprises a dowel vibration device being arranged to vibrate said at least one set of dowel bars into the concrete.

12. The concrete paving machine according to claim 10 wherein said distribution device comprises a series of longitudinal members each having an L-shaped profile, each longitudinal member of said series of longitudinal members forming a predetermined pattern of recesses wherein said series of longitudinal members are slidably arranged so that in said unlocked position said predetermined pattern of recesses of each said longitudinal member is aligned with recesses belonging to another longitudinal member so as to permit distribution of said at least one set of dowel bars onto and across said concrete, said predetermined pattern of recesses of each of said longitudinal members being unaligned with recesses belonging to another longitudinal member in said locked position so as to prevent distribution of said at least one dowel set.

13. The concrete paving machine according to claim 1 wherein said at least one dowel apparatus comprises a dowel vibration device being arranged to vibrate said at least one set of dowel bars into the concrete, said dowel vibration device comprising pressing elements extending downwardly towards the concrete from a vibration device frame supported by said at least one dowel apparatus, wherein said vibration device frame is arranged to move to and from said concrete along a path in the form of a parallelogram.

14. The concrete paving machine according to claim 1 further comprising at least one leveling beam supported by said frame, said at least one dowel apparatus and said leveling beam being arranged with height adjustment means to raise or lower said at least one dowel apparatus and said leveling beam with respect to the concrete.

15. The concrete paving machine according to claim 1 wherein said frame is extensible along said working width, said frame having an extensible guide so that said at least one dowel apparatus is movable along said working width.

16. The concrete paving machine according to claim 1 further comprising a driving means for moving said at least one dowel apparatus along a predetermined sequence along said working width so that at least one dowel set is dropped onto and across the concrete in a pattern substantially along the working width, said driving means including a control means for controlling motion of said at least one dowel apparatus.

17. The concrete paving machine according to claim 1 wherein said at least one dowel apparatus is arranged at a predetermined distance above the concrete.

18. The concrete paving machine according to claim 17 further comprising an adjustment means for automatically controlling and adjusting the predetermined distance of said at least one dowel apparatus from said concrete.

* * * * *